US005149285A

United States Patent [19]

Kinoshita

[11] Patent Number: 5,149,285

[45] Date of Patent: Sep. 22, 1992

[54] TILT/TRIM DEVICE FOR OUTBOARD ENGINE

[75] Inventor: Yutaka Kinoshita, Saitama, Japan

[73] Assignee: Kabushiki Kaisha Showa Seisakusho, Tokyo, Japan

[21] Appl. No.: 547,797

[22] Filed: Jul. 3, 1990

[30] Foreign Application Priority Data

Jul. 3, 1989 [JP] Japan ..... 1-78548

[51] Int. Cl.[5] ..... B63H 5/12

[52] U.S. Cl. ..... 440/61; 60/477; 92/169.1

[58] Field of Search ..... 441/61; 92/169.1, 145; 91/55; 60/412, 473, 474, 475, 476, 477, 478, 479, 480, 588

[56] References Cited

U.S. PATENT DOCUMENTS

| | | | |
|---|---|---|---|
| 2,452,087 | 10/1948 | Wagner | 60/477 |
| 2,679,727 | 6/1954 | McLeod | 60/476 |
| 3,473,325 | 10/1969 | Vargo | 440/61 |
| 3,581,702 | 6/1971 | Moberg . | |
| 3,722,455 | 3/1973 | Carpenter . | |
| 4,391,592 | 7/1983 | Hundertmark . | |
| 4,565,528 | 1/1988 | Nakase . | |
| 4,605,375 | 8/1986 | Ferguson . | |
| 4,720,278 | 1/1988 | Taguchi et al. . | |
| 4,786,263 | 11/1988 | Burmeister et al. . | |
| 4,811,562 | 3/1989 | Hoffmann et al. | 60/475 |
| 4,957,457 | 9/1990 | Probst et al. . | |

FOREIGN PATENT DOCUMENTS

| | | | |
|---|---|---|---|
| 374870 | 8/1921 | Fed. Rep. of Germany | 60/477 |
| 59-118593 | 7/1984 | Japan . | |
| 60-169397 | 9/1985 | Japan . | |
| 251295 | 11/1987 | Japan . | |
| 161914 | 8/1933 | Switzerland | 60/476 |

OTHER PUBLICATIONS

Abstract for Japanese Patent Publication No. 59-118593, dated Jul. 9, 1984, Applicant listed as Riyouichi Nakase.

U.S. Patent Application Ser. No. 07/528,227 filed May 24, 1990, Titled "Trim & Tilt Mechanism For Use With Outboard Engine".

U.S. Patent Application Ser. No. 07/549,203 filed Jul. 6, 1990, Titled "Hydraulic Pressure Mechanism For Lifting and Lowering Outboard Engine".

*Primary Examiner*—Sherman Basinger
*Assistant Examiner*—Thomas J. Brahan
*Attorney, Agent, or Firm*—Merchant, Gould, Smith, Edell, Welter & Schmidt

[57] ABSTRACT

A tilt/trim device for an outboard engine mounted on a transom of a marine vessel includes a stern bracket adapted to be fixedly mounted on the transom, a swivel bracket pivotally supported on the stern bracket, the outboard engine being adapted to be mounted on the swivel bracket, a hydraulic cylinder/piston unit for vertically swinging the swivel bracket with respect to the stern bracket, the hydraulic cylinder/piston unit having one end pivotally coupled to the stern bracket and an opposite end pivotally coupled to the swivel bracket, and a hydraulic circuit hydraulically connected to the hydraulic cylinder/piston unit, for extending and contracting the hydraulic cylinder/piston unit. The hydraulic circuit comprises a main oil tank for storing working oil therein, an auxiliary oil tank for storing working oil therein, the auxiliary oil tank being disposed in a position higher than the main oil tank, and a communication oil passage through which an upper portion of the main oil tank and a lower portion of the auxiliary oil tank communicate with each other, the communication oil passage being inclined upwardly from the main oil tank toward the auxiliary oil tank.

5 Claims, 4 Drawing Sheets

TILT/TRIM DEVICE FOR OUTBOARD ENGINE

BACKGROUND OF THE INVENTION

1. Field of the Invention

The present invention relates to a tilt/trim device for use with an outboard engine on a motorboat.

2. Description of the Relevant Art

Marine propulsion units for use on small marine vessels such as motorboats comprise an outboard engine, a stern bracket fixedly mounted on the transom of the motorboat hull, and a swivel bracket pivotally supported on the stern bracket, the outboard engine being mounted on the swivel bracket. The swivel bracket is vertically swung with respect to the stern bracket by a tilt/trim device. The outboard engine swings with the stern bracket so that the outboard engine can be lifted off the water (tilting action) and can be vertically angularly adjusted underwater (trimming action). The tilt/trim device can also perform the function of absorbing shocks produced when hit by driftwood or other foreign matter.

The tilt/trim device has at least one hydraulic cylinder/piston unit which can be extended or contracted when working oil stored in an oil tank is supplied into or discharged from a cylinder by an oil pump. One type of tilt/trim device has a cylinder/piston unit for effecting the tilting action and another cylinder/piston unit for effecting the trimming action. Another type of tilt/trim device has a single cylinder/piston unit for carrying out both the tilting action and the trimming action.

In the conventional tilt/trim device, if air is trapped in the tank, air bubbles are produced in the working oil in the tank due to vibrations caused by the outboard engine, and are drawn into the oil pump. Therefore, the air bubbles are introduced into the hydraulic circuit, which then fails to supply the working oil under predetermined pressure into the cylinder. When the hydraulic cylinder/piston unit is contracted, a volume of working oil which corresponds to the volume by which the piston enters the cylinder returns to the oil tank, thus increasing the amount of working oil in the oil tank. Therefore, the storage capacity of the oil tank should be large enough to store the necessary amount of working oil. With the large-size oil tank, however, the entire tilt/trim device is large in size.

SUMMARY OF THE INVENTION

According to the present invention, a tilt/trim device for use with an outboard engine includes a hydraulic circuit for extending and contracting a hydraulic cylinder/piston unit under hydraulic pressure, and the hydraulic circuit includes a main oil tank for storing working oil therein, an auxiliary oil tank for storing working oil therein, the auxiliary oil tank being disposed in a position higher than the main oil tank, and a communication oil passage through which an upper portion of the main oil tank and a lower portion of the auxiliary oil tank communicate with each other, the communication oil passage being inclined upwardly from the main oil tank toward the auxiliary oil tank.

The main oil tank and the auxiliary oil tank are disposed one on each side of the hydraulic cylinder/piston unit. The tilt/trim device according to the present invention is compact in its entirety.

The above and further objects, details and advantages of the present invention will become apparent from the following detailed description of a preferred embodiment thereof, when read in conjunction with the accompanying drawings.

DETAILED DESCRIPTION OF THE PREFERRED EMBODIMENT

Figure 1:
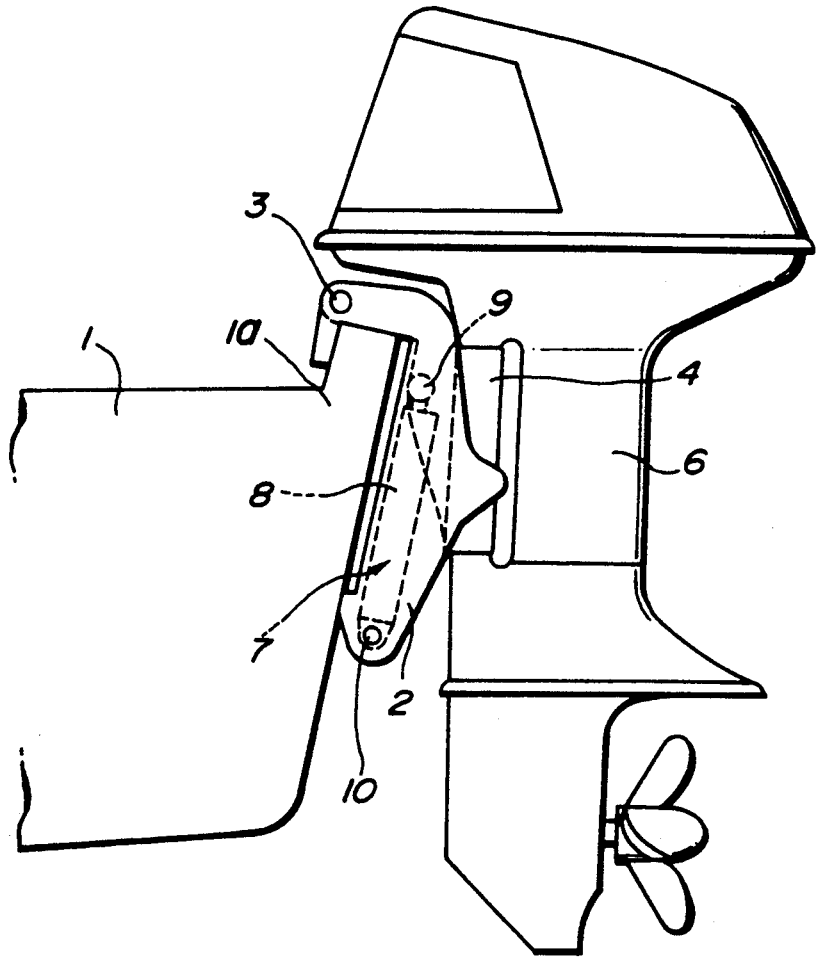
FIG. 1 is a side elevational view of a stern portion of a boat incorporating a tilt/trim device according to the present invention.
Figure 3:
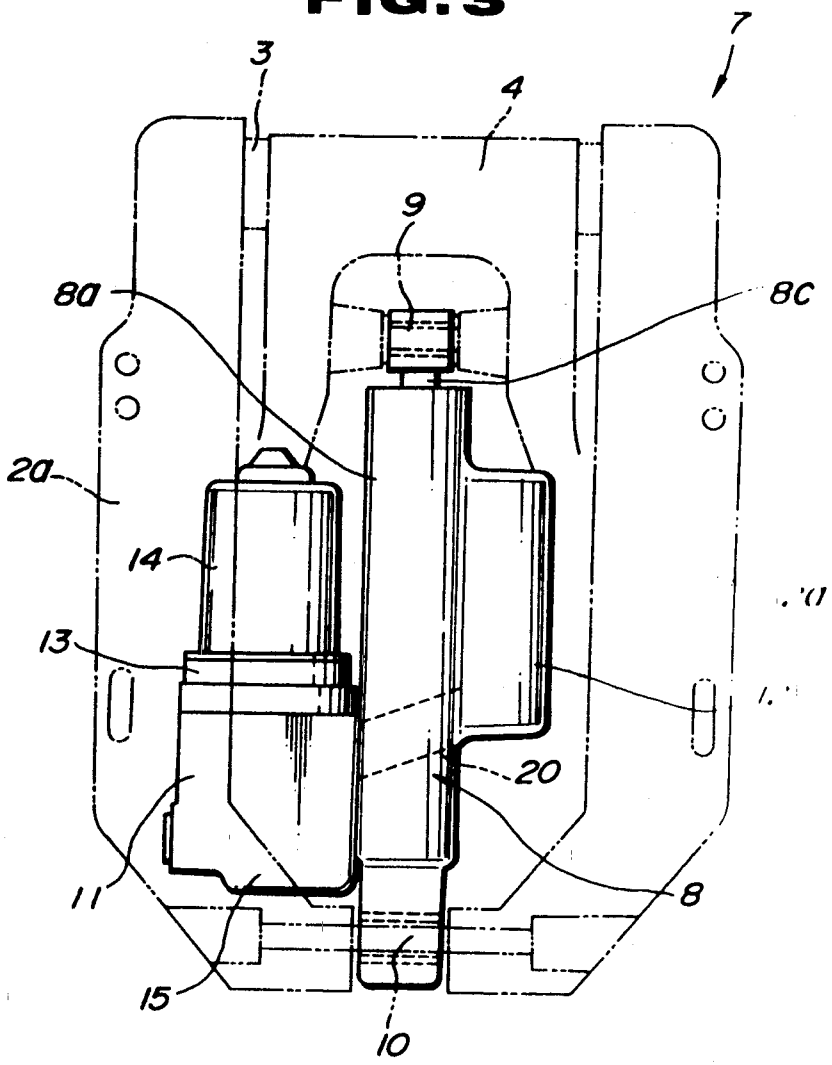
FIG. 3 is an elevational view of the tilt/trim device, as viewed in the direction indicated by the arrow III in FIG. 2.
Figure 2:
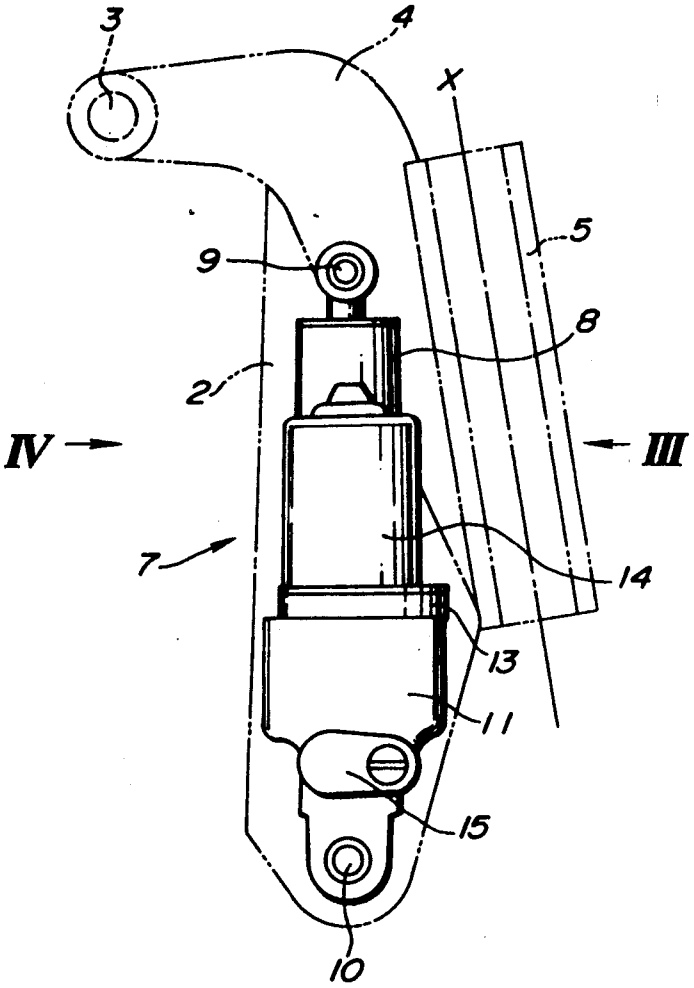
FIG. 2 is an enlarged side elevational view of the tilt/trim device.

As shown in FIG. 3, a stern bracket 2 (FIGS. 1 and 2) has a pair of side plates 2*a* spaced laterally from and extending vertically parallel to each other. The side plates 2*a* are attached to the transom 1*a* of a boat 1 (FIG. 1) in laterally juxtaposed relation. A swivel bracket 4 is pivotally supported on a horizontal support shaft 3 extending between upper ends of the side plates 2*a*. The swivel bracket 4 is vertically angularly movable about the support shaft 3. As shown in FIG. 2, the swivel bracket 4 has a central support pipe 5 extending substantially vertically, and a support shaft (not shown) of an outboard engine 6 is rotatably inserted through the support pipe 5. Therefore, the outboard engine 6 is horizontally rotatable about a steering axis X which extends coaxially through the support pipe 5.

A tilt/trim device 7 according to the present invention is disposed in a space which is surrounded by the transom 1*a*, the stern bracket 2, and the swivel bracket 4.

The tilt/trim device 7 has a hydraulic cylinder/piston unit 8 which includes a piston rod 8*c* (FIG. 3). The piston rod 8*c* has an upper end pivotally coupled to the swivel bracket 4 by a joint pin 9. The hydraulic cylinder/piston unit 8 also has a cylinder 8*a* in which the piston rod 8*c* is slidably movable, the cylinder 8*a* having a lower end pivotally coupled to the stern bracket 2 by a joint pin 10.

Figure 4:
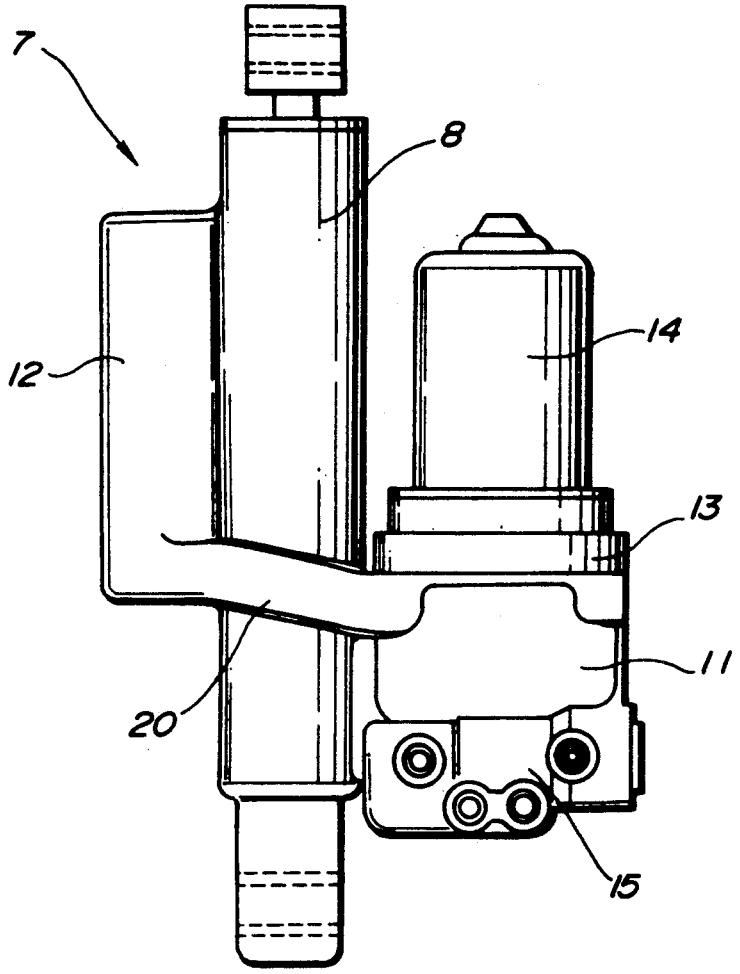
FIG. 4 is an elevational view of the tilt/trim device, as viewed in the direction indicated by the arrow IV in FIG. 2.

As shown in FIGS. 3 and 4, a main oil tank 11 and an auxiliary oil tank 12, both for storing working oil, are disposed respectively on opposite sides of the hydraulic cylinder/piston unit 8. The main oil tank 11 and the auxiliary oil tank 12 are integrally cast with the cylinder 8*a* of the hydraulic cylinder/piston unit 8. An oil pump 13 is mounted on an upper surface of the main tank 11, and a motor 14 for actuating the oil pump 13 is mounted on an upper surface face of the oil pump 13. A spool valve 15 is attached to the lower end of the main oil tank 11.

The auxiliary oil tank 12 is disposed in a position higher than the main oil tank 11. An upper portion of the main oil tank 11 and a lower portion of the auxiliary oil tank 12 are connected to each other by a communication oil passage 20 which is inclined upwardly from the main oil tank 11 toward the auxiliary oil tank 12.

According to the present invention, since the auxiliary oil tank 12 is provided separately from the main oil tank 11, the main oil tank 11 may be of a small storage capacity, and hence may be small in diameter and height.

A hydraulic circuit for actuating the hydraulic cylinder/piston unit 8 will be described below with reference to FIG. 5.

The oil pump 13 which is driven by the motor 14 has two outlet/inlet ports which are connected to the main oil tank 11 through respective check valves 22, and also to left and right chambers P1, P2 respectively, which are defined in a directional control valve 18 by the spool 15 therein. The left chamber P1 of the directional control valve 18 is connected to a lower chamber S2 in the cylinder 8*a* through a check valve 16, whereas the right chamber P2 of the directional control valve 18 is connected to an upper chamber S1 in the cylinder 8*a* through a check valve 17. A manual valve 21 serves to supply the working oil from the main oil tank 11 to the upper and lower chambers S1, S2 in the cylinder 8*a* or return the working oil from the upper and lower chambers S1, S2 to the main oil tank 11, when the lower portion of the outboard engine 6 is manually lifted or lowered. Relief valves 19 are connected to the left and right chambers P1, P2 of the directional control valve 18 and also to an oil passage extending between the manual valve 21 and the lower chamber S2. The relief valves 19 serve to relieve an excessive pressure buildup in the hydraulic circuit.

Figure 5:
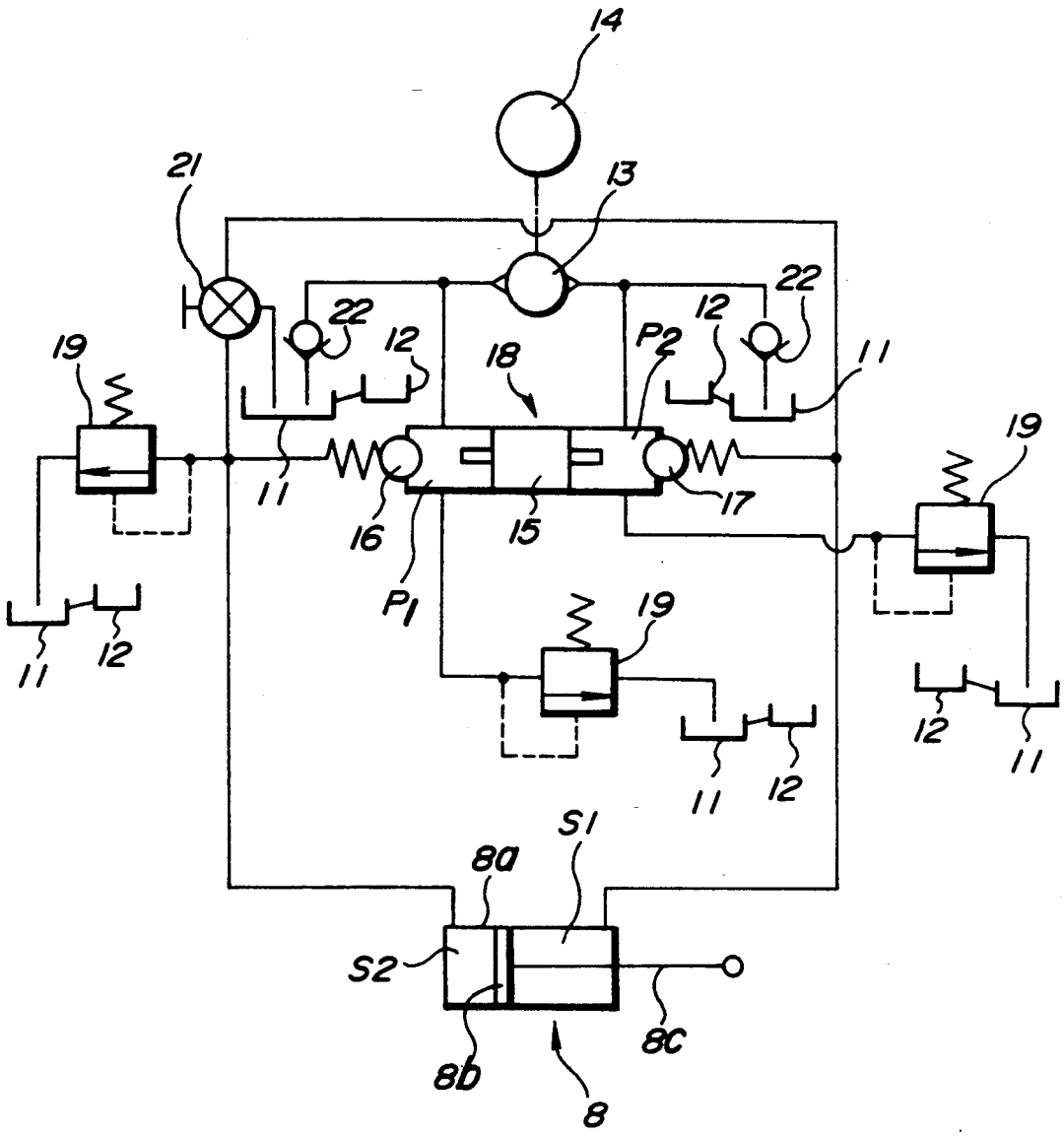
FIG. 5 is a circuit diagram of a hydraulic circuit of the tilt/trim device.

In order to extend the cylinder/piston unit 8 from the condition shown in FIG. 5 in which the spool 15 of the directional control valve 18 is in a neutral position, the oil pump 13 is rotated in a normal direction to supply the working oil to the left chamber P1 of the directional control valve 18. The pressure buildup in the left chamber P1 opens the check valve 16, supplying the working oil to the lower chamber S2 in the cylinder 8*a*. The piston 8*b* moves to the right, thereby extending the cylinder/piston unit 8. At this time, the spool 15 is moved to the right and an end thereof pushes open the check valve 17. Therefore, the working oil in the upper chamber S1 in the cylinder/piston unit 8 returns to the oil pump 13 through the right chamber P2 of the directional control valve 18.

To contract the hydraulic cylinder/piston unit 8, the pump 13 is rotated in a reverse direction to supply the working oil to the right chamber P2 of the directional control valve 18. When the cylinder/piston unit 8 is contracted, a volume of working oil which corresponds to the volume by which the piston rod 8*c* enters the cylinder 8*a* flows back to the main oil tank 11. This volume of working oil which returns to the main oil tank 11 flows through the communication oil passage 20 into the auxiliary oil tank 12. Therefore, the oil level in the auxiliary oil tank 12 rises, while the main oil tank 11 is always filled up with the working oil.

If air were trapped in the main oil tank 11, air bubble would be produced in the working oil due to vibrations of the outboard engine 6, and drawn into the oil pump 13, which would then become unable to deliver the working oil under predetermined pressure. According to the present invention, since the main oil tank 11 is filled up with the working oil at all times, no air bubbles are produced in the working oil in the main oil tank 11. Even if air enters the main oil tank 11, such air quickly flows through the communication oil passage 20 which is inclined upwardly from the upper portion of the main oil tank 11, into the auxiliary oil tank 12. Consequently, the oil pump 13 can discharge the working oil under predetermined pressure at all times.

With the present invention, as described above, no air stays trapped in the main oil tank, and hence no air bubbles are introduced into the hydraulic circuit, with the result that the pressure of the working oil is prevented from being unduly lowered. The overall tilt/trim device is compact because the diameter and height of the main oil tank are small.

Although there has been described what is at present considered to be the preferred embodiment of the present invention, it will be understood that the invention may be embodied in other specific forms without departing from the essential characteristics thereof. The present embodiment is therefore to be considered in all aspects as illustrative, and not restrictive. The scope of the invention is indicated by the appended claims rather than by the foregoing description.

I claim:

1. A tilt/trim device for an outboard engine mounted on a transom of a marine vessel, comprising:

a stern bracket adapted to be fixedly mounted on the transom;

a swivel bracket pivotally supported on said stern bracket, the outboard engine being adapted to be mounted on said swivel bracket;

a hydraulic cylinder/piston unit for vertically swinging said swivel bracket with respect to said stern bracket, said hydraulic cylinder/piston unit having one end pivotally coupled to said swivel bracket; and a hydraulic circuit hydraulically connected to said hydraulic cylinder/piston unit, for extending and contracting the hydraulic cylinder/piston unit;

said hydraulic circuit comprising:

a main oil tank for storing working oil therein;

an auxiliary oil tank for storing working oil therein, said auxiliary oil tank and said main oil tank are disposed one on each side of said hydraulic cylinder/piston unit, said auxiliary oil tank being disposed in a position higher than said main oil tank; and a communication oil passage through which an upper portion of said main oil tank and a lower portion of said auxiliary oil tank communicate with each other, said communication oil passage being inclined upwardly from said main oil tank toward said auxiliary oil tank.

2. A tilt/trim device according to claim 1, wherein said hydraulic circuit as an oil pump, said main oil tank being positioned downwardly of said oil pump and adjacent to said hydraulic cylinder/piston unit.

3. A tilt/trim device according to claim 1, wherein said hydraulic cylinder/piston unit has a cylinder, said main oil tank and said auxiliary oil tank being integral with said cylinder.

4. A tilt/trim device according to claim 3, wherein said main oil tank, said auxiliary oil tank, and said cylinder are integrally cast with each other.

5. A tilt/trim device for an outboard engine mounted on a transom of a marine vessel, comprising:

a stern bracket adapted to be fixedly mounted on the transom;

a swivel bracket pivotally supported on said stern bracket, the outboard engine being adapted to be mounted on said swivel bracket;

a hydraulic cylinder/piston unit for vertically swinging said swivel bracket with respect to said stern bracket, said hydraulic cylinder/piston unit having one end pivotally coupled to said stern bracket and an opposite end pivotally coupled to said swivel bracket, said hydraulic cylinder/piston unit having a cylinder; and a hydraulic circuit hydraulically connected to said hydraulic cylinder/piston unit, for extending and contracting the hydraulic cylinder/piston unit;

said hydraulic circuit comprising:

a main oil tank for storing working oil therein;

an auxiliary oil tank for storing working oil therein, said auxiliary oil tank and said main tank being integrally cast with said cylinder, said auxiliary oil tank being disposed in a position higher than said main oil tank; and a communication oil passage through which an upper portion of said main oil tank and a lower portion of said auxiliary oil tank communicate with each other, said communication oil passage being inclined upwardly from said main oil tank toward said auxiliary oil tank.

* * * * *

UNITED STATES PATENT AND TRADEMARK OFFICE

CERTIFICATE OF CORRECTION

PATENT NO. : 5,149,285

DATED : September 22, 1992

INVENTOR(S) : Kinoshita

It is certified that error appears in the above-identified patent and that said Letters Patent is hereby corrected as shown below:

Column 3, line 55; "bubble" should read --bubbles--.

Column 4, line 28, Claim 1; insert --stern bracket and an opposite end pivotally coupled to said-- after the words "to said".

Column 4, line 48, Claim 2; "as" should read --has--.

Signed and Sealed this

Ninth Day of November, 1993

*Attest:*

*Attesting Officer*

Bruce Lehman

BRUCE LEHMAN

*Commissioner of Patents and Trademarks*